United States Patent [19]

Kato et al.

[11] Patent Number: 4,682,577

[45] Date of Patent: Jul. 28, 1987

[54] METHOD AND APPARATUS FOR REDUCING NOX IN INTERNAL COMBUSTION ENGINE

[75] Inventors: Kenji Kato, Sizuoka; Tokuta Inoue, Mishima; Kiyoshi Nakanishi; Soichi Matsushita, both of Susono, all of Japan

[73] Assignee: Toyota Jidosha Kabushiki Kaisha, Toyota, Japan

[21] Appl. No.: 696,172

[22] Filed: Jan. 29, 1985

[30] Foreign Application Priority Data

Feb. 28, 1984 [JP] Japan ..... 59-37423

[51] Int. Cl.[4] ..... F02D 41/10; F02D 43/04

[52] U.S. Cl. ..... 123/492; 123/422

[58] Field of Search ..... 123/492, 438, 422

[56] References Cited

U.S. PATENT DOCUMENTS 4,232,642 11/1980 Yamaguchi et al. ..... 123/422

4,245,605 1/1981 Rice et al. ..... 123/492

4,312,314 1/1982 McChesney et al. ..... 123/438

4,363,307 12/1982 Amano et al. ..... 123/492

4,408,279 10/1983 Imai et al. ..... 123/492

4,528,961 7/1985 Katoh et al. ..... 123/489

*Primary Examiner*—Andrew M. Dolinar

*Attorney, Agent, or Firm*—Cushman, Darby & Cushman

[57] ABSTRACT

A method of reducing the amount of nitrogen oxides (NOx) in an internal combustion engine in which the air/fuel ratio is controlled higher than a theoreticl air/fuel ratio during normal operation of a vehicle, characterized in that the air/fuel ratio is controlled lower than the theoretical air-fuel ratio for a predetermined period of time during acceleration from the start of acceleration, the control being effected by means for detecting an accelerated state of the vehicle, means for measuring the lapse of time during acceleration from the start of acceleration and means for performing an acceleration increment correction upon detection of acceleration.

11 Claims, 10 Drawing Figures

METHOD AND APPARATUS FOR REDUCING NOX IN INTERNAL COMBUSTION ENGINE

BACKGROUND OF THE INVENTION (1) Field of the Invention

The present invention relates to a method and apparatus for reducing the amount of nitrogen oxides (hereinafter referred to as "NOx") exhausted during acceleration of an internal combustion engine adapted to operate at an air/fuel ratio (hereinafter referred to as "A/F") higher than a stoichiometric value.

(2) Description of the Prior Art

Heretofore, an internal combustion engine control system has been proposed in which the A/F is controlled to a value larger than a stoichiometric value, namely, to a lean side, during normal operation and normal acceleration (hereinafter referred to also as "learn burn engine") mainly for the purpose of improving fuel economization. In this system, an acceleration increment correction has been suggested so that the A/F somewhat decreases to the rich side in comparison with that during normal operation in order to improve the drivability during acceleration.

Lean burn engines of this type permit fuel economization, but as shown in FIG. 7 which represents the amount of NOx produced relative to A/F, if an acceleration increment correction to set the acceleration increment ratio at about 40% is performed in a lean burn engine in which the A/F is set at around "22" (region A in the figure), the A/F shifts to around "16" (region B in the figure), namely, an A/F region with a larger amount of NOx generated. As a result, the amount of NOx exhausted during acceleration increases, which may cause environmental pollution.

SUMMARY OF THE INVENTION

The present invention has been accomplished in view of the above-mentioned problems, and it is the object thereof to reduce the amount of NOx exhausted during acceleration of a lean burn engine, with little increase of fuel consumption.

To this end, the method of the present invention reduces the amount of NOx by reducing the A/F below the theoretical A/F, namely, to a rich side for a predetermined period of time during acceleration from the start of acceleration. The occurrence of an accelerated state is detected to start measuring the lapse of time during acceleration. During a predetermined period, an acceleration increment correction occurs.

These and other objects, features, and advantages of the invention will be apparent from the following detailed description with reference to the attached drawings.

DESCRIPTION OF A PREFERRED EMBODIMENT

Figure 1:
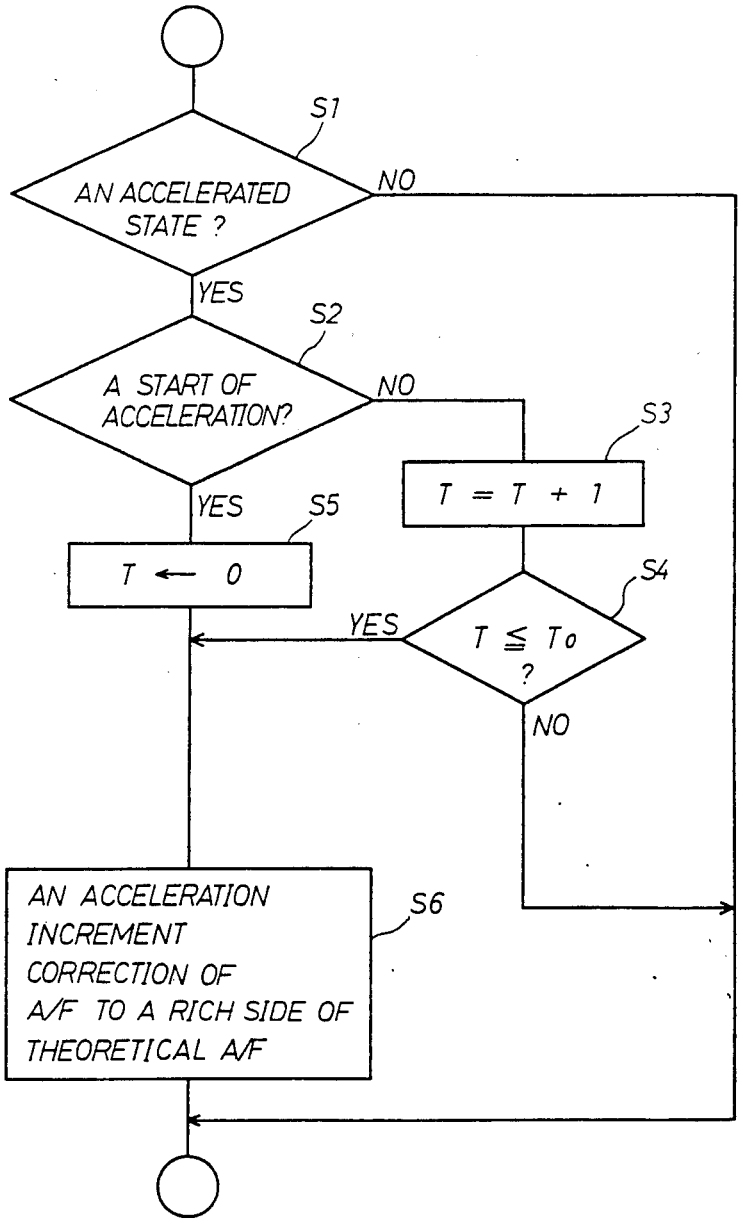
FIG. 1 is a basic block diagram illustrative of the present invention.

FIG. 1 illustrates the basic concept of the present invention. At step s1, it is detected whether the vehicle is in a state of acceleration. If it is not accelerating, the program ends. If vehicle acceleration is detected, then at step S2, it is determined whether acceleration is just starting. If so, a counter T is set to zero at step S5 and an acceleration increment correction is added to cause the A/F fuel ratio to be rich at step S6.

The next pass through the program, assuming that acceleration continues, the determination at step S1 will be positive and the determination at step S2 will be negative. Therefore, the counter T will incremented at step S3. Presuming that the counter T has not reached a predetermined value of $T_0$ the acceleration increment correction continues at step S6.

Once the counter T has reaches a predetermined value of $T_0$, step S4 causes acceleration increment correction to end even though acceleration may be continuing.

The present invention will be described in more detail hereinunder with reference to FIGS. 2 through 8.

Figure 2:
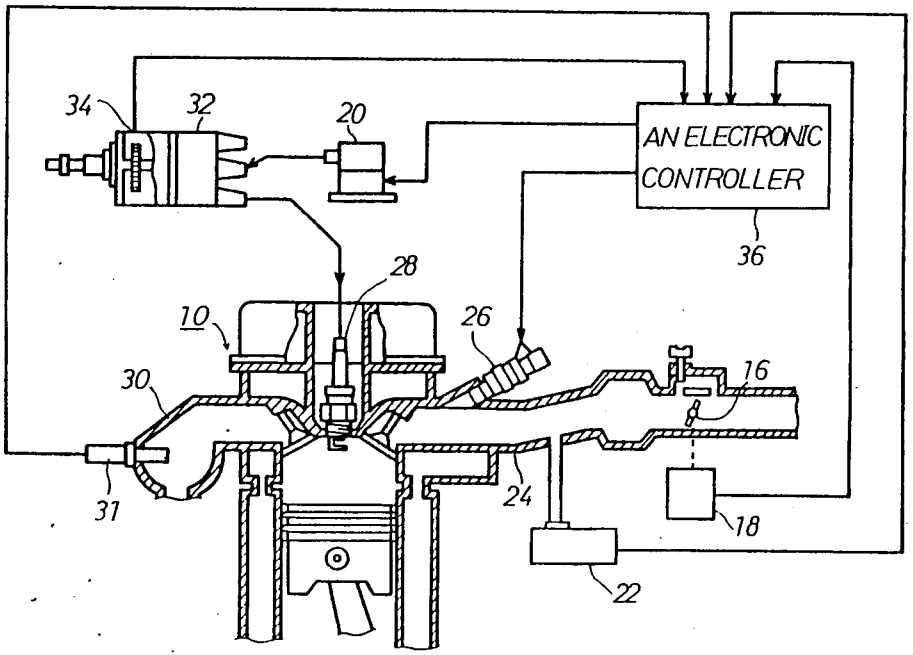
FIG. 2 is an entire block diagram of an example of an engine system for implementing the present invention.

Referring first to FIG. 2, there is illustrated an entire configuration of an example of a system for implementing the present invention, in which in order to detect an operating condition of an engine 10, an intake system is provided with a potentiometer type throttle sensor 18 for detecting the opening of a throttle valve 16 and an intake pipe pressure sensor 22 for detecting a pressure in an intake pipe 24, and in an exhaust system a lean sensor 31 for detecting the oxygen concentration in exhaust gases is attached to an exhaust pipe 30. Further, an electromagnetic pickup type crank angle sensor 34 for detecting both the number of revolutions of the engine 10 and a reference crank angular position is attached to a distributor 32 which supplies a high voltage to a spark plug 28. An electronic controller 36 receives detected signals from these operating condition detecting means, then determines the amount of fuel to be injected and an ignition timing according to the operating condition of the engine 10 and provides a valve-opening signal to an injector 26 and ignition signal to an igniter 20. In addition, Though not shown, a ternary catalyst device is provided downstream of the exhaust pipe 30.

Figure 3:
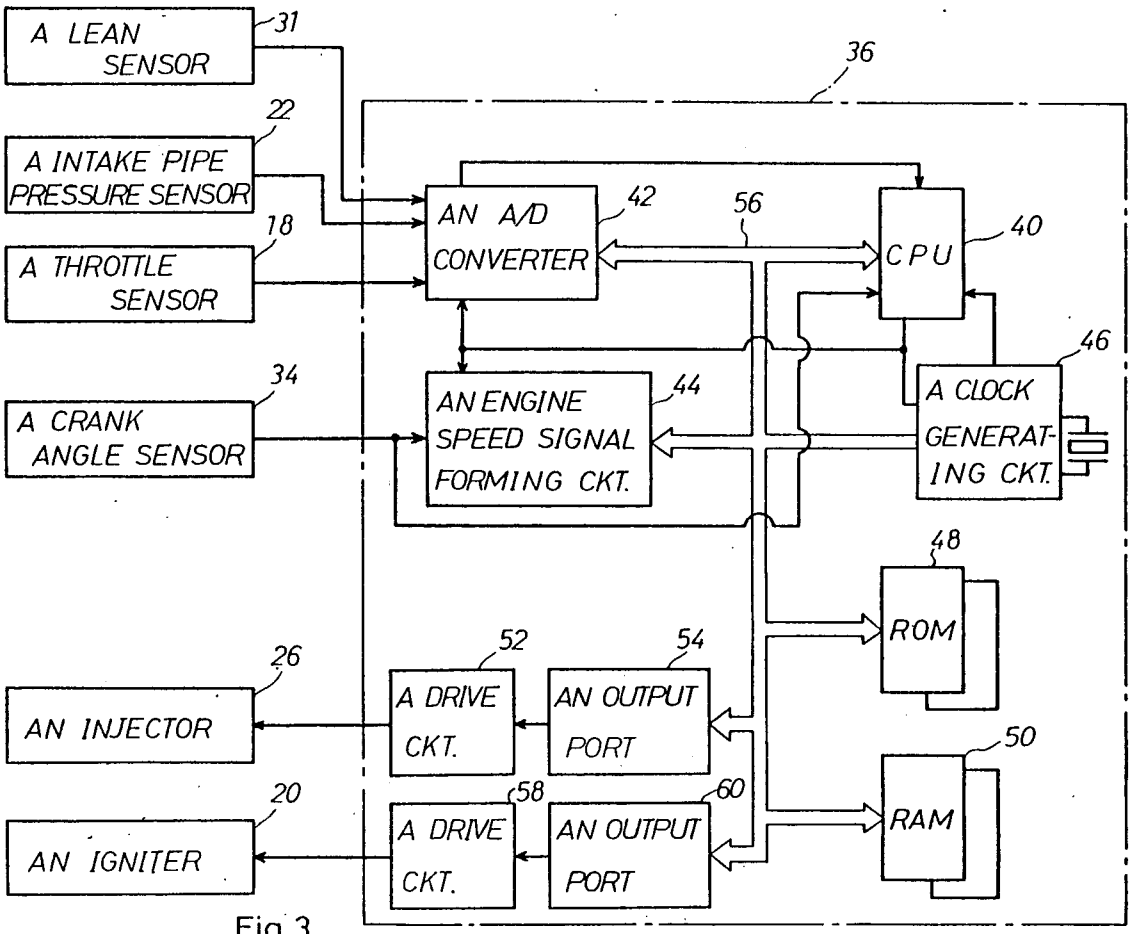
FIG. 3 is a view mainly illustrating the configuration of an electronic controller used in the engine system of FIG. 2.

The electronic controller 36, which is of a known configuration as shown in FIG. 3, includes an A/D converter 42 for converting detected analog signals provided from the lean sensor 31 which detects an A/F higher than a theoretical A/F, the intake pipe pressure sensor 22 and throttle sensor 18 selectively into digital signals; an engine speed signal forming circuit 44 for forming an engine speed signal in accordance with a pulse signal provided from the crank angle sensor 34; a central processing unit (CPU) 40; a read-only memory (ROM) 48; a random access memory (RAM) 50; a clock generation circuit 46; output ports 54 and 60; drive circuits 52 and 58; and a common bus 56.

When an ignition switch (now shown) is turned on to apply power, the CPU 40 starts processings in accordance with a program pre-stored in the ROM 48 in synchronism with a reference clock signal provided from the clock generation circuit 46. Among the processings just mentioned, those related to the present invention are shown in FIGS. 4A–4C, 5 and 6.

Figure 4A:
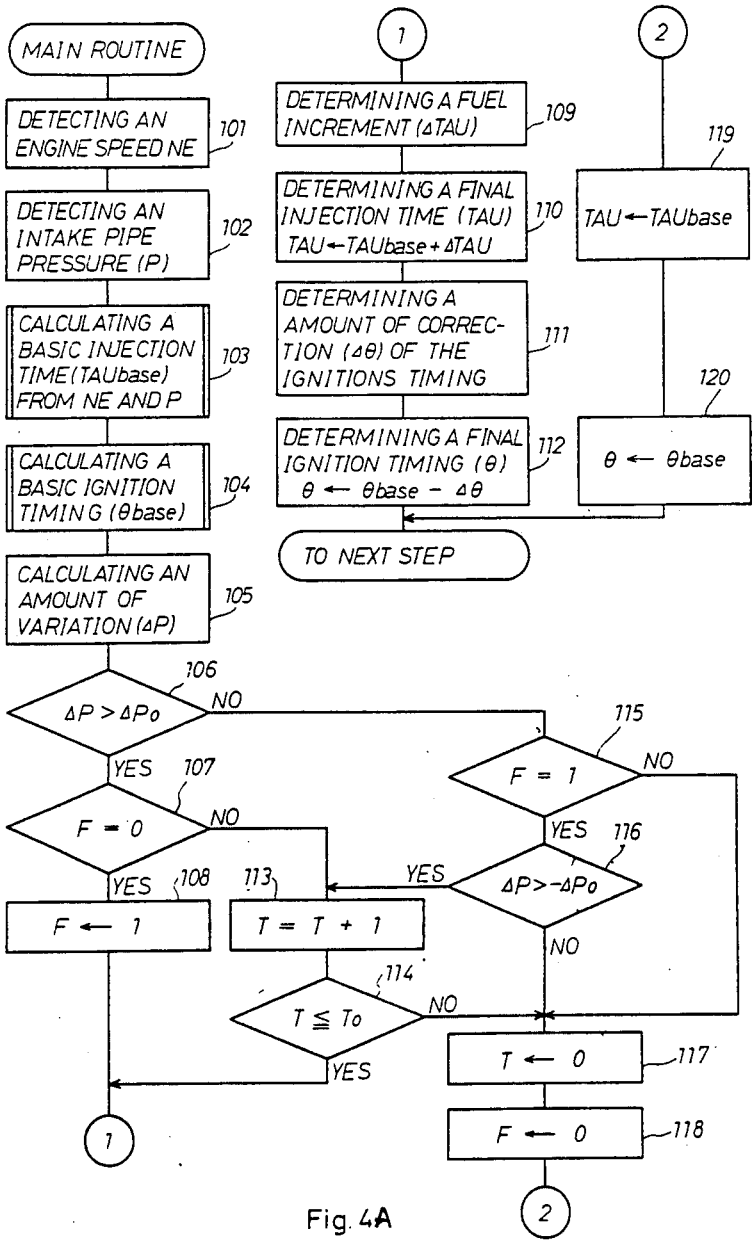
FIGS. 4A-4C, 5 and 6 are flowcharts of processings executed in the method of the present invention.

Referring to FIG. 4A, there is shown a processing which is executed in a main routine. In this processing, steps 101 to 104 are known processing steps for determining a basic injection time, TAUbase, and a basic ignition timing $\theta$base. Step 105 is for calculating an amount of variation $\Delta P$ in intake pipe pressure P in order to determine a state of acceleration of the engine (vehicle). Step 106 is for detecting an accelerated state together with later-described flag F and step 116. When the amount of variation $\Delta P$ is larger than a predetermined value $\Delta Po$, a judgment is made as to whether or not the acceleration is at a start point on the basis of flag F in step 107. At this time, if the flag is "0", it is judged that the acceleration is at a start point, while if it is "1", it is judged that the acceleration is not at a start point. Where it has been judged that the acceleration is at a start point, the flag F is set to "1" in step 108 and then a fuel increment $\Delta TAU$ is determined in step 109. The fuel increment $\Delta TAU$ takes a certain value predetermined so that the A/F is on a richer side than the theoretical A/F or a value corresponding to the amount of variation $\Delta P$. It is stored beforehand in the ROM 48. Next, in step 110, a final injection time TAU is determined by adding the fuel increment $\Delta TAU$ to the basic injection time TAU base, and then the amount of correction $\Delta\theta$ of the ignition timing is determined in step 111. The amount of correction $\Delta\theta$ may be a predetermined constant value or a value corresponding to the engine condition. Then, in step 112, the final ignition timing $\theta$ is determined by substracting the amount of correction $\Delta\theta$ from the basic ignition timing $\theta$ base.

In the execution of this routine after start of acceleration and while the amount of variation $\Delta P$ is larger than the predetermined value $\Delta Po$, since the flag F has been set to "1" at the beginning of acceleration as previously described, the result of judgment in step 107 is normally "NO", the value of a timer T is continued to be incremented in step 113, and the value of the timer T after the increment is compared with a predetermined time To. The predetermined time To is preset to a suitable time width considering the various possible variations of the intake pipe pressure and engine speed appearing later than such pressure variations. For example, on the basis of a pattern with the highest frequency of occurrence among intake pipe pressure variation patterns wherein the amount of variation $\Delta P$ is larger than the predetermined value $\Delta Po$, there is determined a period (here assumed to be Tp) in this pattern, namely, a period in which the amount of variation $\Delta P$ is larger than the predetermined value $\Delta Po$, and the time To is set larger than at least the time Tp. Therefore, during the normal intake pipe pressure variation as mentioned above, an elapsed time T from the start point of acceleration until the amount of variation $\Delta P$ becomes below the predetermined value $\Delta Po$ does not exceed the predetermined time To, so that during this period the result of judgment in step 114 becomes "YES" and the route consisting of steps 101 to 107, 113, 114 and 109 to 112 is executed repeatedly whereby the fuel increment correction and ignition timing correction are performed. When the amount of variation $\Delta P$ becomes below $\Delta Po$, the result of judgment in step 106 turns to "NO", and whether the flag F is "1" or not is judged in step 115. Since at this time, the flag F is already set to "1", the result of judgment in step 115 becomes "YES", and a judgment is made in the next step 116 as to whether the amount of variation $\Delta P$ is larger than the other predetermined value $-\Delta Po$. Even if the amount of variation $\Delta P$ becomes below the predetermined value $\Delta Po$ as mentioned above, the intake pipe pressure continues to increase or becomes an almost constant value, so at this time point the result of judgment in step 116 becomes "YES" and the timer T is incremented in the next step 113. Then in step 114 it is judged that the value of the timer T after the increment is below the predetermined time To and fuel increment correction and ignition timing correction are performed. Thereafter, when it is judged in step 114 that the time of lapse T from the start point of acceleration has exceeded the predetermined time To, the result of judgment in step 114 turns to "NO" and the timer is cleared in the next step 117. Then in step 118 the flag F is reset, and in the following step 119 there is performed an ordinary injection amount calculation not involving fuel increment correction. Then in the next step 120 there is performed an ordinary ignition timing calculation not involving ignition timing correction. If deceleration is made before exceeding the predetermined time To from the start point of acceleration and the amount of variation $\Delta P$ becomes below the predetermined value $-\Delta Po$, the result of judgment in step 116 turns to "NO" and steps 117 to 120 are executed, whereby there are performed ordinary injection amount calculation and ignition timing calculation.

Figure 5:
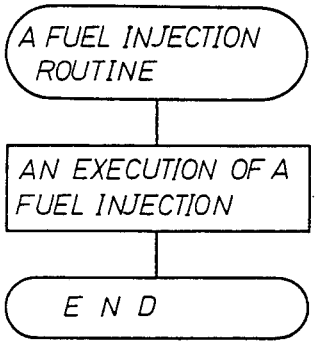
Figure 6:
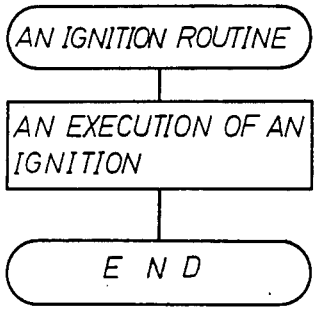

Referring now to FIGS. 5 and 6, there are shown respectively a fuel injection routine and an ignition routine, whose executions are started at predetermined crank angle positions. In these routines, a pulse signal, or a valve-opening signal, corresponding to the final injection time TAU obtained by the main routine is provided to the injector 26, and an ignition signal corresponding to the final ignition timing $\theta$ is provided to the igniter 20.

Figure 7:
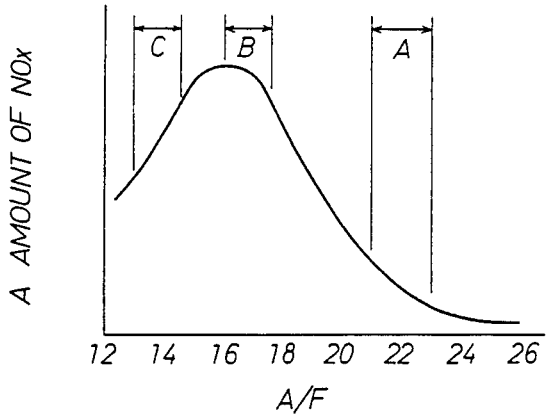
FIGS. 7 and 8 diagrammatically illustrate the amount of NOx produced and percent NOx purification both relative to A/F, respectively.
Figure 8:
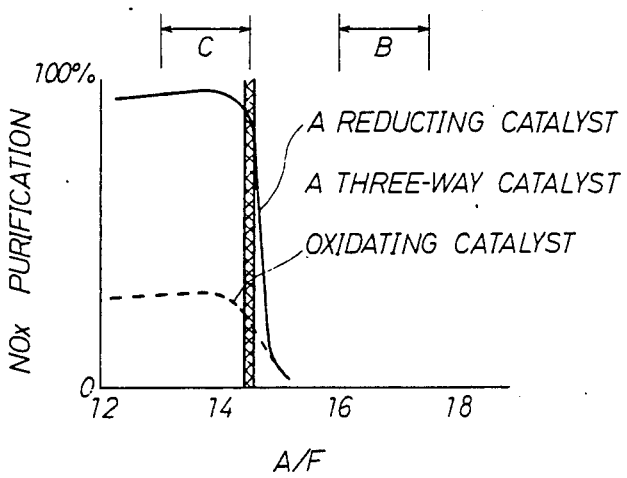

FIG. 7 is a diagram showing the amount of NOx produced relative to A/F. As previously noted, in a lean burn engine in which the A/F is set at around "22" (region A in the figure), the conventional acceleration increment correction with the acceleration increment ratio set at about 40% results in the A/F becoming "16" or so (region B in the figure) in which a larger amount of NOx is produced. On the other hand, if the acceleration increment correction is made according to the present invention, the A/F becomes around "14" (region C in the figure) in which the amount of NOx produced, and thus the amount of NOx produced can be reduced. Also as to the percent NOx purification with a reducing catalyst, it can be improved to a large extent because the A/F is within the region C in FIG. 8 which region corresponds to the range of NOx purification, and consequently little NOx is exhausted.

As to the configuration of the main routine, in the flow chart of FIG. 4A, step 115 may be deleted and a step having the same processing contents as step 115 may be added just after step 108, whereby the number of times of clearing the timer T can be reduced.

According to the present invention, as set forth hereinabove, since the A/F at the beginning of acceleration is controlled to a rich side relative to a theoretical A/F, the amount of NOx produced becomes smaller; besides, the amount of NOx exhausted can be reduced to a large extent because of improvement in the percent NOx purification with a reducing catalyst. In this case, the fuel consumption changes little because the period of controlling the A/F to a rich side relative to the theoretical or stoichiometric A/F is limited to the early period of acceleration. In addition, when this fuel increment correction is combined with the ignition timing correction, the amount of NOx exhausted can be further reduced.

Figure 4B:
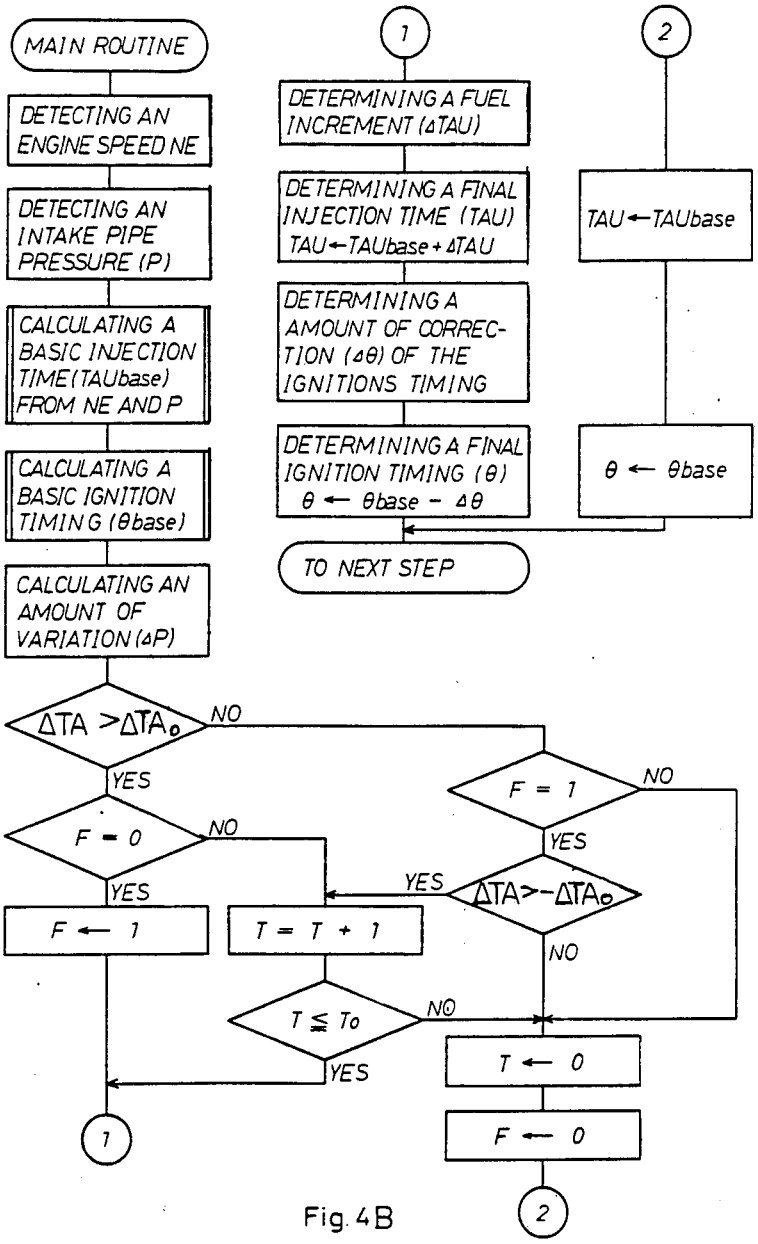
Figure 4C:
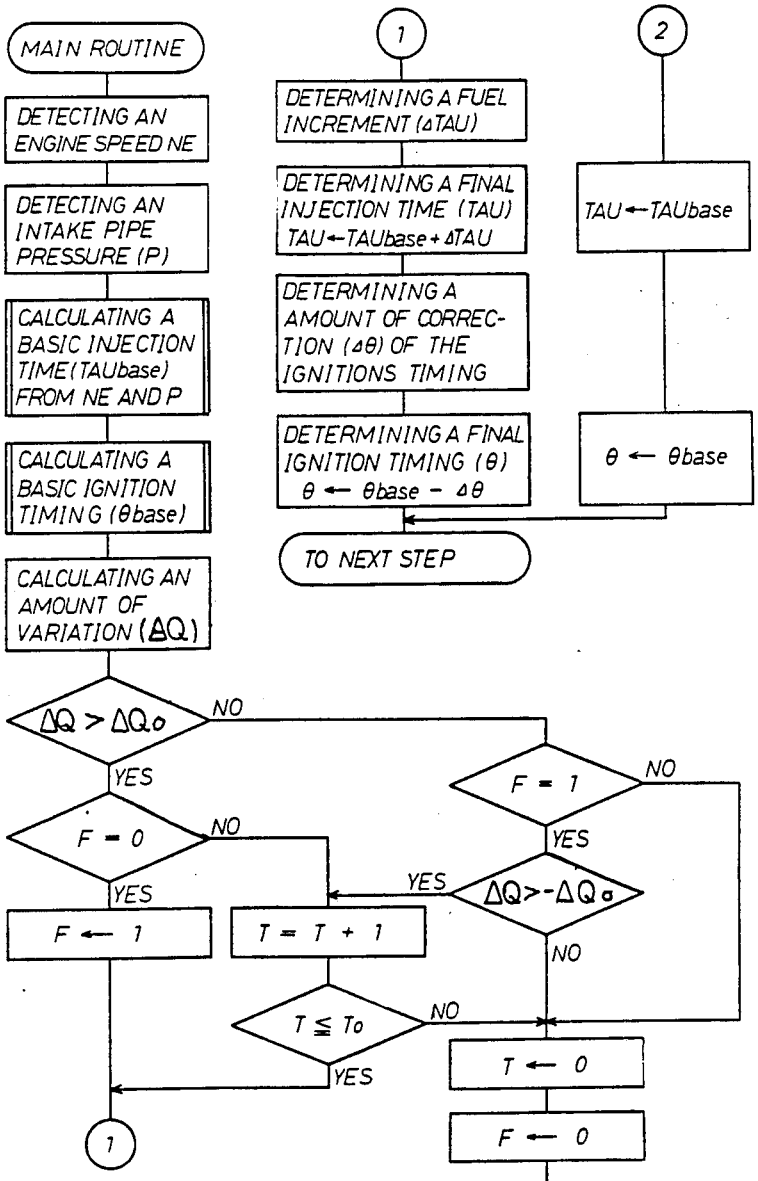

Although in the above embodiment the amount of variation AP in the intake pipe pressure P was determined for detecting an accelerated state, there may be obtained for the same purpose the amount of variation in the throttle valve opening ΔTA or the amount of variation in the intake air volume ΔQ, as shown in FIGS. 4B and 4C, respectively.

While the invention has been described in its preferred embodiment, it is to be understood that the words which have been used are words of description rather than limitation and that various changes and modifications within the purview of the appended claims may be made without departing from the true scope and spirit of the invention in its broader aspects.

What is claimed is:

1. A method of reducing the amount of nitrogen oxides in an internal combustion engine, comprising the steps of:

(a) calculating a basic fuel injection duration;

(b) calculating an amount of variation in an intake pipe pressure;

(c) judging whether or not said amount of variation in the intake pipe pressure is larger than a predetermined value;

(d) measuring an elapsed time from said amount of variation exceeding said predetermined value;

(e) judging whether or not said elapsed time is longer than a predetermined time;

(f) controlling the air/fuel ratio to be greater than a stoichiometric air/fuel ratio in response to said basic fuel injection duration both: (1) when said amount of variation in the intake pipe pressure is below said predetermined value, and (2) when said amount of variation in the intake pipe pressure is larger than said predetermined value and said elapsed time is longer than said predetermined time;

(g) only when said amount of variation in the intake pipe pressure is larger than said predetermined value and said elapsed time is below said predetermined time, adding said basic fuel injection duration to an incremental injection duration as a final injection time; and (h) controlling the air/fuel ratio in accordance with said final injection time when said amount of variation in the intake pipe pressure is greater than said predetermined value and said elapsed time is shorter than said predetermined time, said incremental injection duration causing said final injection time to produce an air/fuel ratio which is smaller than said stoichiometric air/fuel ratio.

2. A method as set forth in claim 1, wherein said predetermined value is determined on the basis of one of the intake pipe pressure and the engine speed.

3. A method as set forth in claim 1, wherein said predetermined value is determined on the basis of engine speed.

4. A method according to claim 1, wherein said controlling step (h) controls the air/fuel ratio to be smaller than the stoichiometric air/fuel ratio when the elapsed time is shorter than said predetermined time and the amount of variation in the intake pipe pressure is greater than a reference value which is lower than said predetermined value.

5. A method of reducing the amount of nitrogen oxides in an internal combustion engine, comprising the steps of:

(a) calculating a basic fuel injection duration;

(b) calculating an amount of variation in a specific volume of intake air;

(c) judging whether or not said amount of variation in the specific volume of intake air is larger than a predetermined value;

(d) measuring an elapsed time from when said amount of variation exceeds said predetermined value;

(e) judging whether or not said elapsed time is longer than a predetermined time;

(f) controlling the air/fuel ratio to be greater than a stoichiometric air/fuel ratio in response to said basic fuel injection duration both:

(1) when said amount of variation in the specific volume of intake air is below said predetermined value, and (2) when said amount of variation in the specific volume of intake air is larger than said predetermined value and said elapsed time is longer than said predetermined time;

(g) only when said amount of variation in the specific volume of intake air is larger than said predetermined value and said elapsed time is below said predetermined time, adding said basic fuel injection duration to an incremental injection duration as a final injection time; and (h) controlling the air/fuel ratio in accordance with said final injection time when said amount of variation in the specific volume of intake air is greater than said predetermined value and said elapsed time is shorter than said predetermined time, said incremental injection duration causing said final injection time to produce an air/fuel ratio which is smaller than said stoichiometric air/fuel ratio.

6. A method of reducing the amount of nitrogen oxides in an internal combustion engine, comprising the steps of:

(a) calculating a basic fuel injection duration;

(b) calculating an amount of variation in a throttle position;

(c) judging whether or not said amount of variation in the throttle position is larger than a predetermined value;

(d) measuring an elapsed time from when said amount of variation exceeds said predetermined value;

(e) judging whether or not said elapsed time is longer than a predetermined time;

(f) controlling the air/fuel ratio to be greater than a stoichiometric air/fuel ratio in response to said basic fuel injection duration both:

(1) when said amount of variation in the throttle position is below said predetermined value, and (2) when said amount of variation in the throttle position is larger than said predetermined value and said elapsed time is longer than said predetermined time;

(g) only when said amount of variation in the throttle position is larger than said predetermined value and said elapsed time is below said predetermined time, adding said basic fuel injection duration to an incremental injection duration as a final injection time; and (h) controlling the air/fuel ratio in accordance with said final injection time when said amount of variation in the throttle position is greater than said predetermined value and said elapsed time is shorter than said predetermined time, said incremental injection duration causing said final injection time to produce an air/fuel ratio which is smaller than said stoichiometric/fuel ratio.

7. A method according to claim 1, 5, or 6, wherein an ignition timing is controlled to be advanced during said state of acceleration.

8. An apparatus for reducing nitrogen oxides in an internal combustion engine comprising:

means for generating a speed signal in response to an engine speed;

means for generating a condition signal indicating a condition of the engine; and processing means for:

(1) generating a basic fuel injection signal indicating a basic fuel injection duration in response to said speed signal and said condition signal, (2) generating a pressure variation signal indicating an amount of variation in an intake pipe pressure;

(3) judging whether or not said variation signal exceeds a reference pressure signal, (4) measuring an elapsed time from a time when said pressure variation signal exceeds said reference pressure signal, (5) judging whether or not said elapsed time is longer than a preset time internal, (6) controlling an air/fuel ratio signal in response to said basic injection signal to be greater than a stoichiometric air/fuel ratio signal both:

(a) when said pressure variation signal is smaller than said reference signal, and (b) when said pressure variation signal is greater than said reference pressure signal and said elapsed time is longer than said preset time interval, (7) generating an incremental injection signal in response to said basic fuel injection signal, (8) generating a final injection signal in response to said basic injection signal and said incremental injection signal, and (9) controlling the air/fuel ratio signal in response to said final injection signal when said pressure variation signal is greater than said reference pressure signal and said elapsed time is shorter than said preset time interval, said incremental injection signal causing said final injection time to produce an air/fuel ratio which is smaller than said stoichiometric air/fuel ratio.

9. An apparatus for reducing nitrogen oxides in an internal combustion engine comprising:

means for generating a speed signal in response to an engine speed;

means for generating a condition signal indicating a condition of the engine; and processing means for:

(1) generating a basic fuel injection signal indicating a basic fuel injection duration in response to said speed signal and said condition signal;

(2) generating a volume variation signal indicating an amount of variation in a specific volume of intake air;

(3) judging whether or not said variation signal exceeds a reference volume signal;

(4) measuring an elapsed time from a time when said volume variation signal exceeds said reference volume signal;

(5) judging whether or not said elapsed time is longer than a preset time interval;

(6) controlling an air/fuel ratio signal in response to said basic fuel injection signal volume to be greater than a stoichiometric air/fuel ratio signal both:

(a) when said volume variation signal is smaller than said reference signal, and (b) when said volume variation signal is greater than said reference volume signal and said elapsed time is longer than said preset time interval;

(7) generating an incremental injection signal in response to said basic fuel injection signal;

(8) generating a final injection signal in response to said basic injection signal and said incremental injection signal; and (9) controlling the air/fuel ratio signal response to said final injection signal when said volume variation signal is greater than said reference volume signal and said elapsed time is shorter than said preset time interval, said incremental injection signal causing said final injection time to produce an air/fuel ratio which is smaller than said stoichiometric air/fuel ratio.

10. An apparatus for reducing nitrogen oxides in an internal combustion engine comprising:

means for generating a speed signal in response to an engine speed;

means for generating a condition signal indicating a condition of the engine; and processing means for:

(1) generating a basic fuel injection signal indicating a basic fuel injection duration in response to said speed signal and said condition signal;

(2) generating a throttle position variation signal indicating an amount of variation in a throttle position;

(3) judging whether or not said variation signal exceeds a reference throttle position signal;

(4) measuring an elapsed time from a time when said throttle position variation signal exceeds said reference throttle position signal;

(5) judging whether or not said elapsed time is longer than a preset time interval;

(6) controlling an air/fuel ratio signal in response to said basic fuel injection throttle position variation signal to be greater than a stoichiometric air/fuel ratio signal both:

(a) when said throttle position variation signal is smaller than said reference signal, and (b) when said throttle position variation signal is greater than said reference throttle position signal and said elapsed time is longer than said preset time interval;

(7) generating an incremental injection signal in response to said basic fuel injection signal;

(8) generating a final injection signal in response to said basic injection signal and said incremental injection signal; and (9) controlling the air/fuel ratio signal in response to said final injection signal when said throttle position variation signal is greater than said reference throttle position signal and said elapsed time is shorter than said preset time interval, said incremental injection signal causing said final injection time to produce an air/fuel ratio which is smaller than said stoichiometric air/fuel ratio.

11. An apparatus according to claim 8, 9 or 10 wherein said processing means controls an ignition timing means such that it is advanced when said air/fuel ratio is adjusted to be smaller than said stoichiometric air/fuel ratio.

* * * * *